US012545485B2

(12) United States Patent
Linguiti et al.

(10) Patent No.: US 12,545,485 B2
(45) Date of Patent: Feb. 10, 2026

(54) CLOSURE ASSEMBLY FOR A CONTAINER AND CONTAINER HAVING A CLOSURE ASSEMBLY

(71) Applicant: Tetra Laval Holdings & Finance S.A., Pully (CH)

(72) Inventors: Martina Linguiti, Modena (IT); Angelo Sorbara, Rubiera (IT); Franco Cani, Asti (IT); Tiziano Viani, Bibbiano (IT); Luca Gori, Bologna (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 45 days.

(21) Appl. No.: 18/246,587

(22) PCT Filed: Jun. 28, 2021

(86) PCT No.: PCT/EP2021/067610
§ 371 (c)(1),
(2) Date: Mar. 24, 2023

(87) PCT Pub. No.: WO2022/073660
PCT Pub. Date: Apr. 14, 2022

(65) Prior Publication Data

US 2023/0365311 A1 Nov. 16, 2023

(30) Foreign Application Priority Data

Oct. 5, 2020 (EP) ..... 20200060

(51) Int. Cl.
*B65D 55/16* (2006.01)
*B65D 41/34* (2006.01)
(Continued)

(52) U.S. Cl.
CPC ..... *B65D 55/16* (2013.01); *B65D 41/3447* (2013.01); *B65D 41/50* (2013.01);
(Continued)

(58) Field of Classification Search
CPC .... B65D 55/16; B65D 41/3447; B65D 41/50; B65D 47/2012; B65D 51/226;
(Continued)

(56) References Cited

U.S. PATENT DOCUMENTS 4,512,485 A 4/1985 Agbay et al.
6,325,227 B1 12/2001 Ekkert
(Continued)

FOREIGN PATENT DOCUMENTS

CN 101848841 A 9/2010
CN 105658531 A 6/2016
(Continued)

OTHER PUBLICATIONS

English translation of WO 2020/178012 (Year: 2024).*
(Continued)

*Primary Examiner* — James N Smalley
(74) *Attorney, Agent, or Firm* — BUCHANAN INGERSOLL & ROONEY PC

(57) ABSTRACT

A closure assembly for a container filled or fillable with a pourable product comprising at least a lid having a first rim, a ring member having a second rim facing the first rim and one or more coupling elements, each one being connected to the first rim and to the second rim. Each coupling element comprises at least one respective intermediate portion, one respective first curved portion connected to the first rim and the intermediate portion and one respective second curved portion connected to the second rim and the intermediate portion. The intermediate portion is inclined with respect to the first rim and/or the second rim.

18 Claims, 4 Drawing Sheets

(51) Int. Cl.
*B65D 41/50* (2006.01)
*B65D 47/20* (2006.01)
*B65D 51/22* (2006.01)

(52) U.S. Cl.
CPC ..... *B65D 47/2012* (2013.01); *B65D 51/226* (2013.01); *B65D 2251/0015* (2013.01); *B65D 2251/009* (2013.01); *B65D 2401/30* (2020.05)

(58) Field of Classification Search
CPC ..... B65D 2251/0015; B65D 2251/009; B65D 2401/30
See application file for complete search history.

(56) References Cited

U.S. PATENT DOCUMENTS

| | | | | |
|---|---|---|---|---|
| 2008/0124432 | A1 | 5/2008 | Ma | |
| 2010/0288784 | A1 | 11/2010 | Alvares et al. | |
| 2013/0043260 | A1 | 2/2013 | Barron | |
| 2014/0230379 | A1 | 8/2014 | Casale et al. | |
| 2016/0016703 | A1 | 1/2016 | Muhlemann | |
| 2016/0325879 | A1 | 11/2016 | Martini et al. | |
| 2019/0144158 | A1 | 5/2019 | Hauser et al. | |
| 2022/0002021 | A1 * | 1/2022 | Krautkramer ..... | B65D 41/3428 |
| 2022/0119174 | A1 | 4/2022 | De Paola et al. | |
| 2023/0025075 | A1 | 1/2023 | Leuenberger et al. | |
| 2023/0373690 | A1 | 11/2023 | Linguiti et al. | |

FOREIGN PATENT DOCUMENTS

| | | | | |
|---|---|---|---|---|
| CN | 110626624 | A | 12/2019 | |
| CN | 111516986 | A | 8/2020 | |
| DE | 4410323 | A1 | 9/1995 | |
| DE | 102016110047 | B3 | 5/2017 | |
| DE | 102019132541 | B3 | 11/2020 | |
| EP | 3670377 | A1 | 6/2020 | |
| EP | 3715271 | A1 | 9/2020 | |
| EP | 3715272 | A1 | 9/2020 | |
| EP | 3805126 | A1 | 4/2021 | |
| EP | 3868680 | A1 | 8/2021 | |
| EP | 3978387 | A1 | 4/2022 | |
| EP | 4065483 | A1 | 10/2022 | |
| EP | 4166472 | A1 | 4/2023 | |
| JP | 2008-001420 | A | 1/2008 | |
| JP | 2008056246 | A | 3/2008 | |
| JP | 2010083488 | A | 4/2010 | |
| JP | 2011-500461 | A | 1/2011 | |
| JP | 2013230822 | A | 11/2013 | |
| WO | 2005/044670 | A2 | 5/2005 | |
| WO | 2009/048273 | A2 | 4/2009 | |
| WO | 2012034836 | A1 | 3/2012 | |
| WO | 2020109282 | A1 | 6/2020 | |
| WO | WO-2020178012 | A1 * | 9/2020 | ..... B65D 41/34 |
| WO | 2020212430 | A1 | 10/2020 | |
| WO | 2020/0251984 | A1 | 12/2020 | |
| WO | 2021105176 | A1 | 6/2021 | |

OTHER PUBLICATIONS

International Search Report mailed Jul. 21, 2021, for priority International Patent Application No. PCT/EP2021/067610.

European Search Report dated Jan. 18, 2023, for corresponding European Divisional Patent Application No. 22207151.6.

Office Action (Notice of Reasons for Refusal) issued on Apr. 3, 2025, in corresponding Japanese Patent Application No. 2023-515567 and English translation of the Office Action. (12 pages).

Office Action/Search Report (The First Office Action) issued on Apr. 8, 2025, in corresponding Chinese Patent Application No. 202180068212.1 and English translation of the Office Action/Search Report. (17 pages).

Office Action/Search Report (The First Office Action) issued on Apr. 8, 2025, in corresponding Chinese Patent Application No. 202180068215.5 and English translation of the Office Action/Search Report. (17 pages).

U.S. Appl. No. 18/246,590 filed on Mar. 24, 2023, "Closure Assembly For a Container and Container Having a Closure Assembly", published as U.S. Patent Application Publication No. 2023/0373690, naming Martina Linguiti et al. as inventors.

Notice of Reasons for Refusal issued on Jul. 31, 2025, by the Japanese Patent Office in Japanese Patent Application No. 2023-515598 and an English translation of the Action. (12 pages).

Office Action issued on Sep. 17, 2025, by the China National Intellectual Property Administration in Chinese Patent Application No. 202180068212.1. (7 pages).

* cited by examiner

CLOSURE ASSEMBLY FOR A CONTAINER AND CONTAINER HAVING A CLOSURE ASSEMBLY

TECHNICAL FIELD

The present invention relates to a closure assembly for a container, in particular a container filled or fillable with a pourable product, even more particular a container filled or fillable with a pourable food product.

The present invention also relates to a container filled or fillable with a pourable product, even more particular a container filled or fillable with a pourable food product, having a closure assembly.

BACKGROUND ART

As is known, many liquid or pourable food products, such as fruit juice, UHT (ultra-high-temperature treated) milk, wine, tomato sauce, etc., are sold in containers, such as composite packages, bottles, cans and the like.

It is furthermore known that often such containers are provided with a closure assembly so as to selectively allow outpouring of the pourable product from the container.

A typical closure assembly comprises a collar, which is connected to the container, having a pouring outlet allowing the outpouring of the pourable product from the container and a lid configured to selectively open and close the pouring outlet and being connected to the collar when closing the pouring outlet.

It is further known that the closure assembly typically comprises a ring member coupled to and surrounding the collar. The axial movement of the ring member along the collar is typically limited by means of an annular ridge radially protruding from the collar so as to guarantee that the ring member remains coupled to the collar.

Furthermore, prior to the first removal of the lid, the ring member and the lid are connected to one another by means of coupling bridges, which rupture during the first removal of the lid from the collar. After the first removal of the lid from the collar, the ring member and the lid are detached from one another.

An inconvenience is seen in that the lid is disconnected from the ring member and, thus, when removing the lid from the collar for opening the pouring outlet, the lid is detached and distinct from the container. This means e.g. that a user needs to keep the lid in one hand and the container needs to be kept in the other one. Furthermore, such inconvenience may lead to an undesired littering of the lid.

In order to overcome such inconveniences, it has been proposed to tether the lid to the ring member by means of a connection element. Even though such closure assemblies work satisfyingly well, a desire is felt in the sector to further improve such closure assemblies.

DISCLOSURE OF INVENTION

It is therefore an object of the present invention to provide in a straightforward and low-cost manner an improved closure assembly for containers, in particular filled or fillable with a pourable product, even more particular filled or fillable with a pourable food product.

Advantageously, it is a further object of the present invention to provide in a straightforward and low-cost manner an improved closure assembly for containers, which comes along with a minimal strain acting on the ring members during operation of the respective lids.

Advantageously, it is another object of the present invention to provide in a straightforward and low-cost manner a container, in particular filled or fillable with a pourable product, even more particular filled or fillable with a pourable food product, having a closure assembly, which comes along with a minimal strain acting on the ring members during operation of the respective lids.

According to the present invention, there is provided a closure assembly according to independent claim 1.

Further advantageous embodiments of the closure assembly are specified in the dependent claims.

According to the present invention, there is also provided a container according to claim 15.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Number 1 indicates as a whole a container, such as a bottle, a (composite) package, a can, or the like, comprising a main body 2 and a closure assembly 3 coupled or couplable to main body 2.

Preferably but not necessarily, container 1 is filled or fillable with a pourable product, in particular a pourable food product, even more particular a sterilized and/or a sterile-processed pourable food product, such as fruit juice, milk (e.g. ultra-high-temperature treated milk), water, wine, tomato sauce, sugar, salt and others.

The following description will refer to composite containers 1, in particular to containers 1 whose main body 2 is obtained from a web of packaging material having a multilayer structure, although this is in no way intended to limit the scope of protection as defined by the accompanying claims.

In particular, the web of packaging material comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defines the inner face of main body 2 contacting the pourable product.

Preferably but not necessarily, the web of packaging material also comprises a layer of gas- and light-barrier material, e.g. aluminum foil or ethylene vinyl alcohol (EVOH) film, in particular being arranged between one of the layers of heat-seal plastic material and the layer of fibrous material. Preferentially but not necessarily, the web of packaging material also comprises a further layer of heat-seal plastic material being interposed between the layer of gas- and light-barrier material and the layer of fibrous material.

According to a preferred non-limiting embodiment, main body 2 defines a sealed package, in particular a sealed carton package, having a designated pour opening surface area (not shown and known as such), and closure assembly 3 is fitted to main body 2, in particular about the designated pour opening surface area.

According to a preferred non-limiting embodiment, closure assembly(ies) 3 is(are) applied to main body(ies) 2 prior, during or after formation, filling and sealing of main body(ies) 2 by means of a molding process and/or adhesive bonding and/or ultrasonic bonding.

Alternatively, closure assembly(ies) 3 can be applied onto the web of packaging material prior to arranging the web of packaging material within or during advancement of the web of packaging material within a packaging machine for forming, filling and sealing main body(ies) 2 from the web of packaging material.

Figure 1:
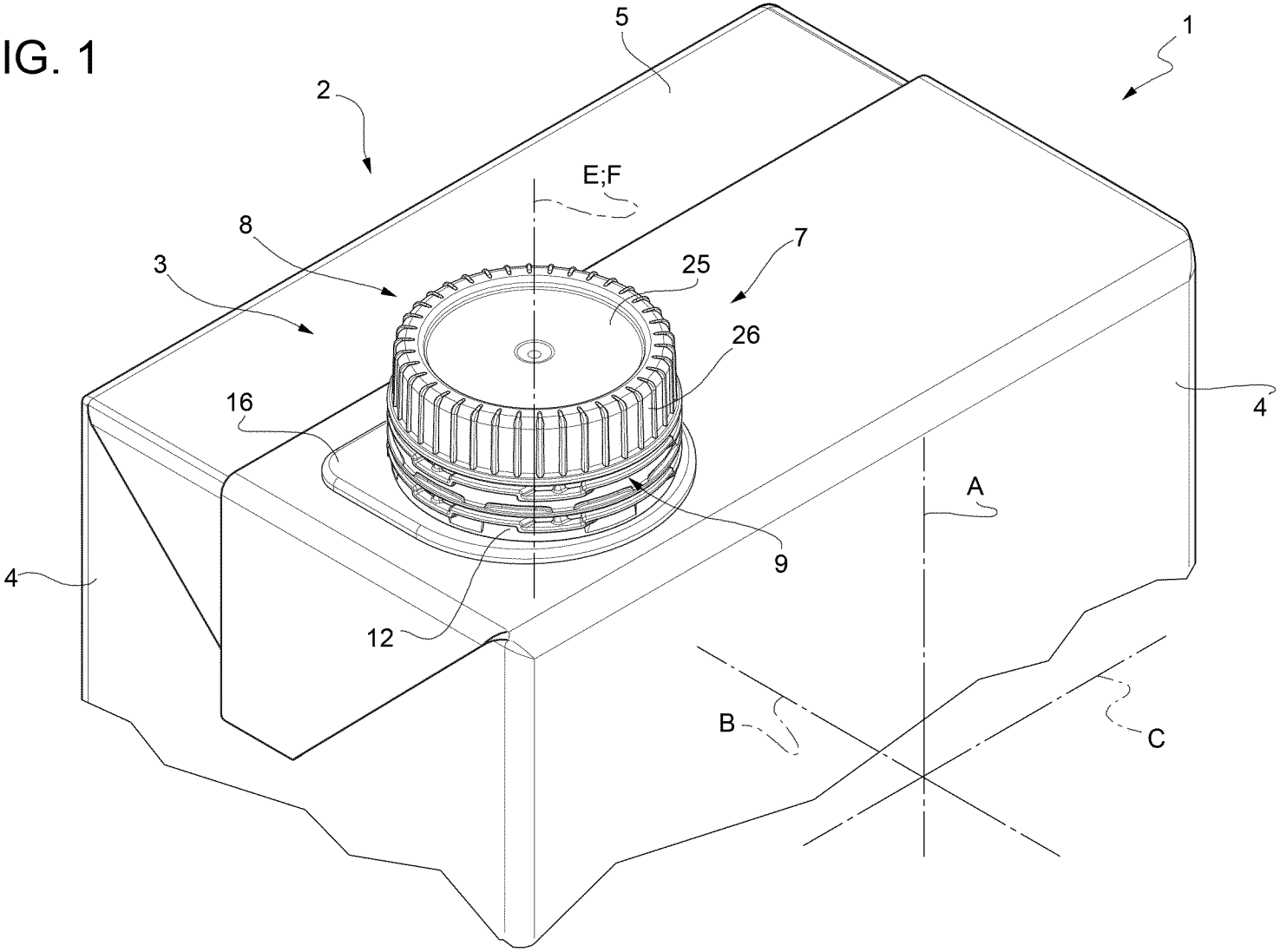
FIG. 1 is a schematic perspective view of a portion of a container having a closure assembly according to the present invention, with parts removed for clarity.

With particular reference to FIG. 1, main body 2 extends along a longitudinal axis A, a first transversal axis B and a second transversal axis C. In particular, axis A is perpendicular to axis B and axis C and axis B and axis C are perpendicular to one another.

Preferentially but not necessarily, the extension of main body 2 along axis A is larger than the extension of main body 2 along axis B and axis C.

Preferentially but not necessarily, main body 2 is parallelepiped-shaped.

According to the non-limiting embodiment disclosed, main body 2 comprises a first wall portion, in particular being transversal, even more particular perpendicular, to axis A, from which main body 2 extends along axis A. Preferably but not necessarily, the first wall portion defines a support surface of container 1, in particular main body 2, which, in use, can be put in contact with a support, such as e.g. a shelf, when, in use, being e.g. exposed within a sales point or when being stored. In particular, when being arranged on a support and/or, in use, during consumption of the pourable product by a consumer from container 1 the first wall portion defines a bottom wall portion.

Preferably but not necessarily, main body 2 also comprises a plurality of lateral walls 4 being (fixedly) connected to the first wall portion and extending, in particular substantially parallel to axis A, from the first wall portion.

Preferably but not necessarily, main body 2 also comprises at least one second wall portion 5 opposite to the first wall portion and being (fixedly) connected to lateral walls 4. In other words, lateral walls 4 are interposed between the first wall portion and second wall portion 5. In particular, when being arranged on a support and/or, in use, during consumption of the pourable product by a consumer from container 1, second wall portion 5 defines a top wall portion.

According to some non-limiting embodiments, the first wall portion and second wall portion 5 may be parallel to one another. Alternatively, the first wall portion and second wall portion 5 could be inclined with respect to one another.

According to some non-limiting embodiments, second wall portion 5 comprises the designated pour opening surface area.

According to a preferred non-limiting embodiment, the designated pour opening surface area of main body 2 comprises a pouring hole allowing for the outflow of the pourable product from main body 2.

According to a preferred non-limiting embodiment, the designated pour opening surface area also comprises a separation membrane sealing the pouring hole. In particular, the separation membrane is configured to retain the pourable product within main body 2 when being intact and to be at least partially (and non-reversibly) openable and/or rupturable and/or cuttable and/or pierceable so as to allow the outflow of the pourable product from main body 2 through at least a portion of the pouring hole. In particular, the separation membrane is configured to allow the outflow of the pourable product after its loss of integrity and to protect the pourable product from the outer environment prior to its cutting and/or opening and/or rupturing and/or piercing.

Preferentially but not necessarily, the separation membrane comprises a gas- and light-barrier material, e.g. aluminum foil or ethylene vinyl alcohol (EVOH) film.

According to a preferred non-limiting embodiment, the separation membrane is defined by a portion of the web of packaging material, in particular a portion of the layers of the web of packaging material being different from the layer of fibrous material.

According to a preferred non-limiting embodiment, closure assembly 3 comprises and/or is formed from a polymeric material.

In alternative, closure assembly 3 could comprise and/or is formed from a metallic material.

With particular reference to FIGS. 1 to 4, closure assembly 3 comprises at least a closing group 7 having at least:

- a lid 8;
- a ring member 9; and
- one or more coupling elements 10, in the specific case shown two coupling elements 10, connected to lid 8 and to ring member 9.

Preferentially, closing group 7 is molded as a single piece from a molten polymer.

It should be noted that coupling elements 10 are connected to lid 8 and ring member 9 in a non-rupturable manner and/or at least a separation-resistant manner. This means that upon a normal use of closure assembly 3 coupling elements 10 remain connected to lid 8 and ring member 9. In particular, connecting elements 10 are connected to lid 8 and ring member 9 such to resist an acting force, which exceeds the forces that typically act during a normal use of closure assembly 3. An example of the occurrence of such an exceeding acting force is the case when a user intends to willingly detach coupling elements 10 from lid 8 and/or ring member 9 by pulling lid 8 and ring member 9 along different directions from one another.

In particular, connecting elements 10 tether lid 8 and ring member 9 with one another.

According to some preferred non-limiting embodiments, closure assembly 3 also comprises one or more rupturable first coupling bridges 11 connecting ring member 9 and lid 8 with one another. In particular, and as explained in more detail further below, first coupling bridges 11 are configured to rupture during a first-time operation of lid 8 (by a consumer).

Preferentially but not necessarily, closure assembly 3 also comprises a tamper-evidence ring 12 and one or more rupturable second coupling bridges 13 connecting tamper-evidence ring 12 and ring member 9 with one another. In particular, and as explained in more detail further below, second coupling bridges 13 are configured to rupture during the first-time operation of lid 8.

In particular, ring member 9 is interposed between lid 8 and tamper-evidence ring 12.

According to some non-limiting embodiments, closure assembly 3 also comprises a collar 14 delimiting and/or defining and/or having a pouring outlet 15, pouring outlet 15 being configured to allow for the outflow of the pourable product from container 1.

In particular, collar 14 is arranged about the pouring hole.

According to some preferred non-limiting embodiments, collar 14 extends along a longitudinal axis E. In particular, collar 14 has an annular shape, in particular an annular cross-sectional shape with respect to a sectional plane being orthogonal to longitudinal axis E.

In particular, collar 14 defines and/or delimits and/or comprises a flow channel for the pourable product. Even more particular, the flow channel is interposed and/or is designed to be interposed between pouring outlet 15 and the pouring hole.

According to some non-limiting embodiments, ring member 9 and/or tamper-evidence ring 12 is/are mounted to and arranged around collar 14.

Preferentially, second ring member 9 and/or tamper-evidence ring 12 is/are coaxial to collar 14.

Preferentially, lid 8 is connected and/or connectable to collar 14 and is configured to selectively close and open pouring outlet 15 for respectively impeding and allowing the outflow of the pourable product from container 1 through pouring outlet 15.

According to some preferred non-limiting embodiments, lid 8 is controllable in at least a closing position (see FIGS. 1 to 4) in which lid 8 closes and/or is configured to close pouring outlet 15 and an opening position (not shown) in which lid 8 opens and/or is configured to open the pouring outlet 15.

Preferentially but not necessarily, lid 8 is controlled in the closing position and the opening position with lid 8 being respectively coupled to and detached from collar 14. In particular, lid 8 is coaxial to collar 14 and/or pouring outlet 15 when being controlled in the closing position and preferentially but not necessarily is transversal to collar 14 when being controlled in the opening position. In other words, when lid 8 is arranged in the closing position lid 8 is connected to collar 14 and covers pouring outlet 15 and when lid 8 is arranged in the opening position lid 8 is detached from collar 14 and clears pouring outlet 15.

In more detail, in the specific example disclosed, lid 8 is controlled between the closing position and the opening position by means of a screwing action. In particular, lid 8 comprises an inner threaded portion, in particular arranged at an inner surface of lid 8, and collar 14 comprises an outer threaded portion, in particular arranged at an outer surface of collar 14. Preferentially, the inner threaded portion and the outer threaded portion are configured to allow for selectively fastening and loosening lid 8 to and from collar 14 by means of a relative rotation between lid 8 and collar 14.

According to some non-limiting embodiments, the inner threaded portion and/or the outer threaded portions define a cam mechanism.

It should be noted that prior to the first-time control (first-time operation) of lid 8 from the closing position to the opening position, first coupling bridges 11 connect ring member 9 and lid 8 with one another and, in use, during the first time lid 8 is controlled from the closing position to the opening position, first coupling bridges 11 irreversibly rupture.

In particular, and in an equivalent manner, second coupling bridges 13 connect ring member 9 and tamper-evidence ring 12 with one another prior to the first-time control of lid 8 from the closing position to the opening position and, in use, during the first time lid 8 is controlled from the closing position to the opening position, second coupling bridges 13 irreversibly rupture.

According to some non-limiting embodiments, closure assembly 3 further comprises a coupling base 16 carrying collar 14 and being configured to couple and/or connect and/or being coupled and/or connected to main body 2.

Preferentially but not necessarily, coupling base 16 is configured to be fixed and/or is fixed to an outer surface of main body 2, in particular of second wall portion 6. In particular, coupling base 16 is arranged in the area of, even more particular at, the designated pour opening surface area.

In particular, coupling base 16 comprises an opening, and collar 14 surrounds the opening so that, in use, with the separation membrane being opened and/or cut and/or ruptured and/or pierced a fluid connection between the inside of main body 2 and pouring outlet 15 is established (i.e. the pourable product can flow out of container 1).

Preferentially but not necessarily, at least a portion of coupling base 16 (substantially) has a plate-like configuration.

According to some preferred non-limiting embodiments, closure assembly 3, in particular collar 14, comprises an interaction device configured to interact with ring member 9 for preventing ring member 9 from decoupling from collar 14. In particular, interaction device is configured to delimit an axial movement of ring member 9 along longitudinal axis E.

In more detail, the interaction device comprises, in particular consists of, an annular ridge 17 (radially) protruding from collar 14. In particular, annular ridge 17 (radially) protrudes from and away of an outer surface of collar 14. According to some preferred non-limiting embodiments, annular ridge 17 has a continuous shape. Alternatively, annular ridge 17 could have a discontinuous shape (e.g. annular ridge 17 could be formed from a multitude of single pieces protruding from collar 14).

According to some preferred non-limiting embodiments, closure assembly 3 comprises an interaction unit, in particular coupled to collar 14, configured to interact with ring member 9 and/or tamper-evidence ring 12 so as to actuate rupture of first coupling bridges 11 and/or second coupling bridges 13 during the first time lid 8 is controlled from the closing position to the opening position.

Figure 2:
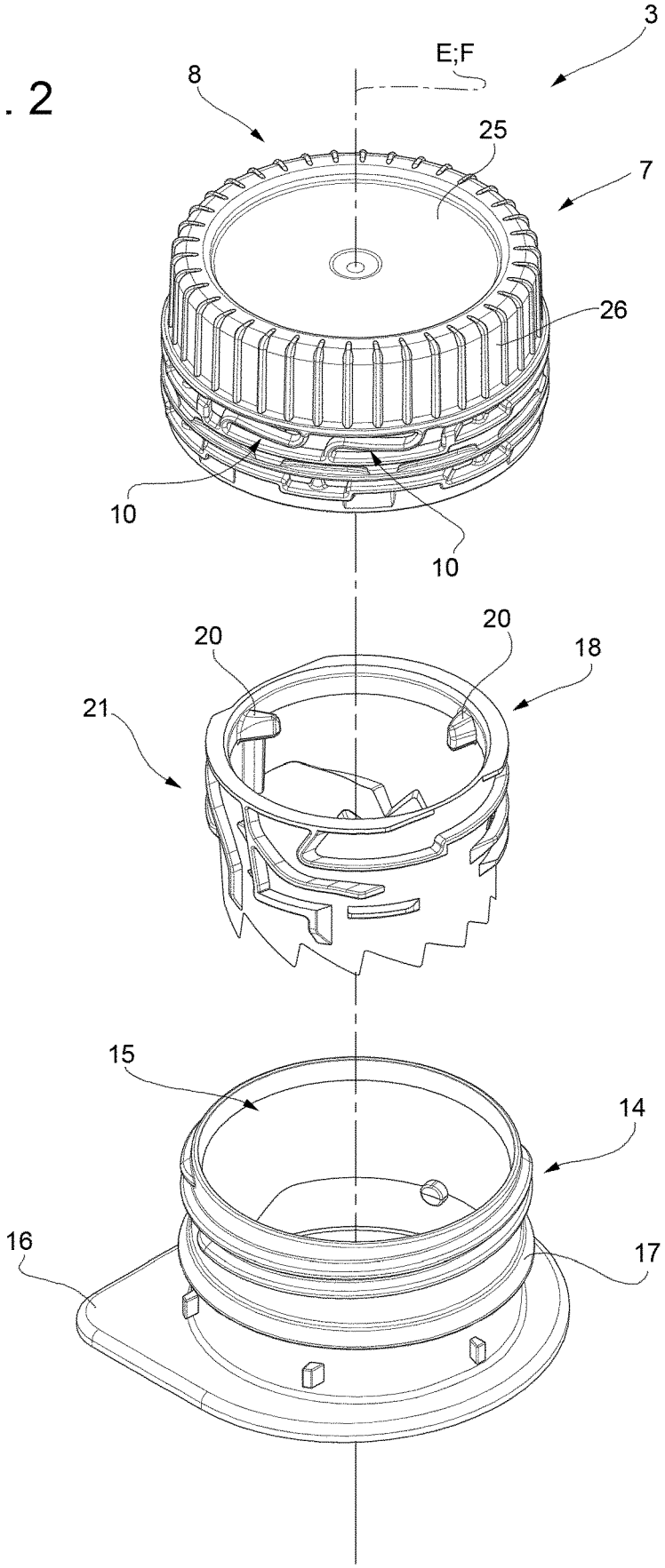
FIG. 2 is an exploded view of the closure assembly of FIG. 1, with parts removed for clarity.

With particular reference to FIG. 2, closure assembly 3 also comprises a cutting device 18 configured to rupture and/or pierce and/or cut and/or open the separation membrane and a control device configured to control cutting device 18 from a rest position to an operative position in which cutting device 18 is adapted to rupture and/or pierce and/or cut and/or open the separation membrane.

Preferentially but not necessarily, cutting device 18 has an annular shape and is arranged within the flow channel of collar 14 when being arranged in the rest position and protrudes at least partially out of the flow channel when being controlled in the operative position.

In particular, cutting device 18 is arranged in the rest position prior to the first time lid 8 is controlled from the closing position to the opening position and is arranged in the operative position after the first control of lid 8 to the opening position.

Preferentially but not necessarily, cutting device 18 is in an axially raised position (with respect to longitudinal axis E) when being arranged in the rest position and with respect to the operative position.

According to some non-limiting embodiments, the control device comprises control flaps 19, in particular connected to lid 8, interaction elements 20 connected to cutting device 18 and a cam mechanism 21 (see FIG. 2; known as such and not described in detail) partially associated to cutting device 18 and partially associated to collar 14.

According to some non-limiting embodiments not shown, cam mechanism 21 could comprise respective threaded portions.

Preferentially but not necessarily, the control device is configured to be activated during the first time control of lid 8 from the closing position to the opening position so as to (irreversibly) move cutting device 18 from the rest position to the operative position.

With particular reference to FIGS. 1 to 4, ring member 9 comprises a central axis F. In particular, central axis F is parallel, even more particular coaxial to, longitudinal axis E with ring member 9 and/or closure assembly 3 being coupled to collar 14.

In particular, central axis F defines a central axis of closing group 7.

Preferentially, lid 8 is coaxial to ring member 9 and/or central axis F with lid 8 being arranged in the closing position.

Preferentially, tamper-evidence ring 12 is coaxial to ring member 9 and/or central axis F.

With particular reference to FIGS. 1 to 4, lid 8 comprises:

- a top wall 25 configured to cover pouring outlet 15 with lid 8 being in the closing position; and
- a side wall 26 (axially) protruding from top portion 25 and in particular being configured to at least partially surround collar 14 with lid 8 being controlled in the closing position.

Preferentially, side wall 26 has a respective annular cross-sectional profile, in particular with respect to a cross-sectional plane perpendicular to longitudinal axis E and/or central axis F and with lid 8 being in the closing position.

In particular, and with lid 8 being arranged in the closing position, top wall 25 is transversal, in particular perpendicular, to central axis F and side wall 26 is (substantially) parallel to longitudinal axis E and/or central axis F.

According to some possible non-limiting embodiments, lid 8 is, in particular top wall 25 and/or side wall 26 are, coupled to and are detached from collar 14 when lid 8 is, in use, in the closing position and the opening position, respectively.

According to some preferred non-limiting embodiments, lid 8, in particular side wall 26, comprises a first rim 27. In particular, first rim 27 delimits an opening of lid 8 opposed to top wall 25.

First rim 27 may comprise a first surface 28.

In more detail, first surface 28 extends within a first plane, in particular first plane being perpendicular to longitudinal axis E and/or central axis F with lid 8 being arranged in the closing position.

According to some preferred non-limiting embodiments, ring member 9 comprises a second rim 29 facing first rim 27, in particular with lid 8 being arranged in the closing position.

Second rim 29 may have a second surface 30 facing first surface 28.

In more detail, second surface 30 extends within a second plane. Preferentially, the second plane is parallel to the first plane, in particular with lid 8 being in the closing position.

Figure 3:
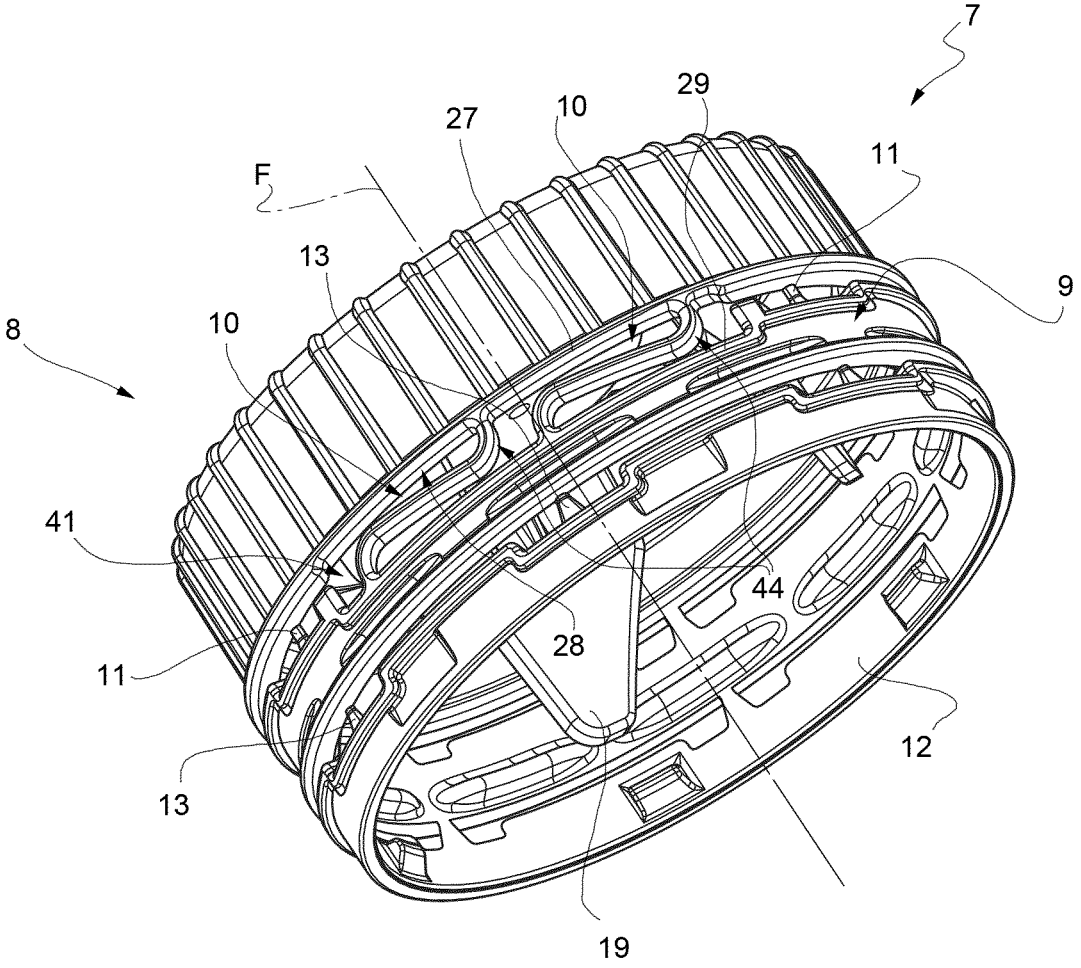
FIG. 3 is an enlarged perspective view of details of the closure assembly of FIG. 1, with parts removed for clarity.
Figure 4:
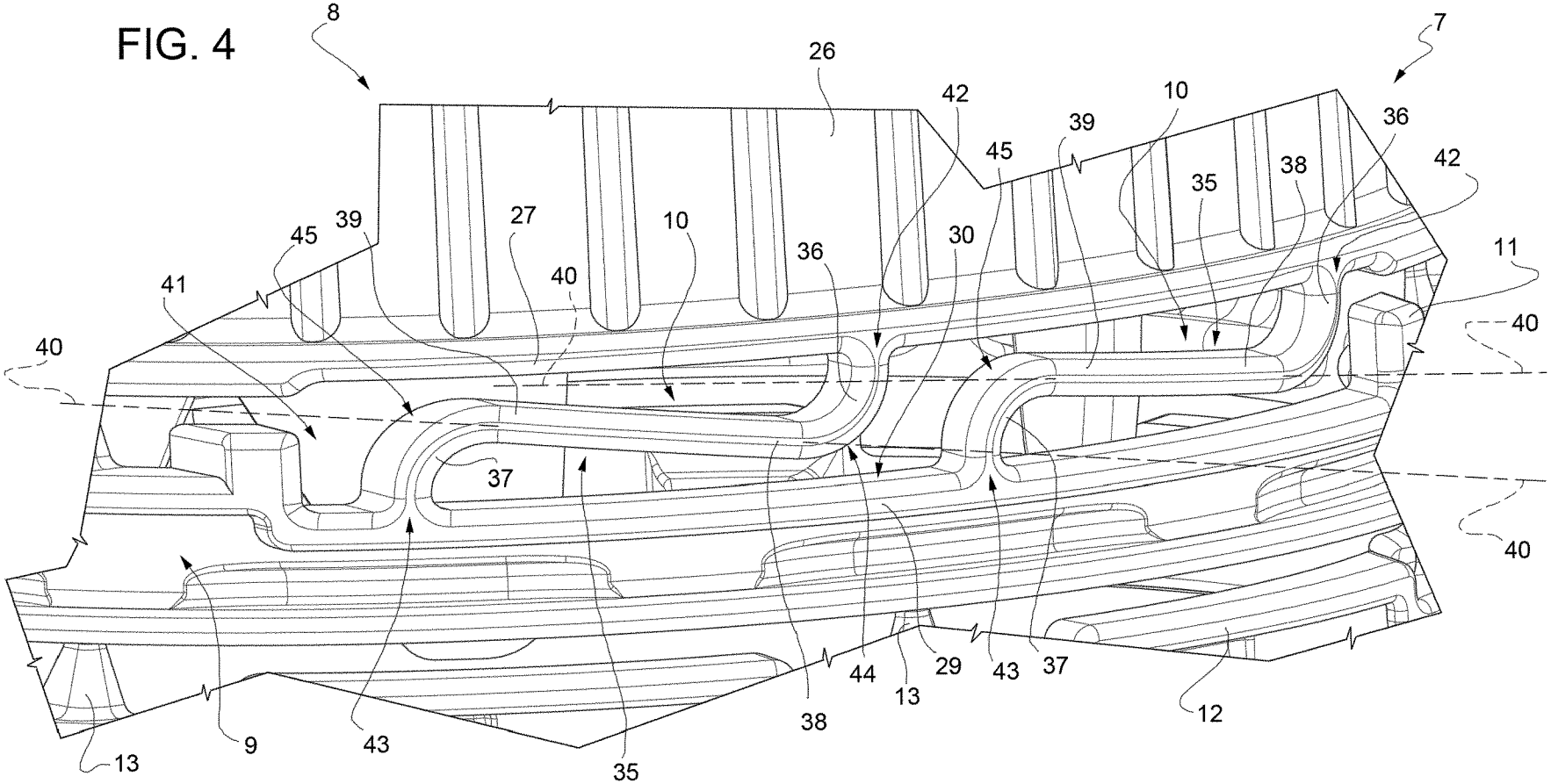
FIG. 4 is a further enlarged perspective view of details of the closure assembly of FIG. 1, with parts removed for clarity.

With particular reference to FIGS. 2 to 4, each coupling element 10 comprises at least:

- one respective (linear) intermediate portion 35;
- one respective first curved portion 36 connected to lid, in particular first rim 27, even more particular first surface 28, and intermediate portion 35; and
- one respective second curved portion 37 connected to ring member 9, in particular second rim 29, even more particular second surface 30, and intermediate portion 35.

In other words, each connecting element 10 comprises intermediate portion 35 being interposed between first curved portion 36 and second curved portion 37.

In more detail, each intermediate portion 35 comprises a first end 38 and a second end 39 opposite to first end 38. Preferentially, intermediate portion 35 (substantially and) linearly extends between first end 38 and second end 39.

In particular, first curved portion 36 is connected to first end 38 and second curved portion 37 is connected to second end 39.

Preferentially, each connecting element 10 is S-shaped. Advantageously, each intermediate portion 35 is inclined with respect to and/or is not parallel to lid 8, in particular first rim 27, even more particular first surface 28, preferentially in the absence of any external stress and/or forces acting on closure assembly 3 (as possibly resulting from a user operating closure assembly 3).

Alternatively or in addition, each intermediate portion 35 is inclined with respect to and/or is not parallel to ring member 9, in particular second rim 29, even more particular second surface 30, preferentially in the absence of any external stress and/or forces acting on closure assembly 3 (as possibly resulting from a user operating closure assembly 3).

Preferentially, each intermediate portion 35 is inclined with respect to and/or is not parallel to the first plane and/or the second plane, in particular in the absence of any external stress and/or strain and/or forces acting on closure assembly 3 (as possibly resulting from a user operating closure assembly 3).

In other words, each intermediate portion 35 comprises at least two imaginary linear projections 40, one linearly extending from and away of first end 38 and the other one linearly extending from and away of second end 39. In particular, imaginary linear projections 40 intersect with the first plane and/or the second plane.

According to some preferred non-limiting embodiments, each intermediate portion 35 is inclined with respect to central axis F and/or longitudinal axis E. In particular, each intermediate portion 35 is transversal, but not perpendicular to central axis F and/or longitudinal axis E (i.e. each intermediate portion 35 describes with central axis F and/or longitudinal axis E an angle ranging between 0° and 90° with 0° and 90° being excluded).

Preferentially, closure assembly 3 comprises an interspace 41 arranged between and/or delimited by lid 8, in particular first rim 27, even more particular first surface 28, and ring member 9, in particular second rim 29, even more particular second surface 30, and each coupling element 10 is positioned within interspace 41.

With particular reference to FIGS. 2 to 4, each first curved portion 36 is connected to first rim 27, in particular first surface 30, at a respective first position 42 and each second curved portion 37 is connected to second rim 29, in particular second surface 30, at a respective second position 43.

Advantageously, each first position 42 and the respective second position 43 are angularly, in particular also axially, displaced from one another, in particular around (and along) central axis F. In particular, also first positions 42 are angularly displaced from one another and also second positions 43 are angularly displaced from one another.

According to some preferred non-limiting embodiments, each first curved portion 36 is convex with respect to ring member 9 and each second curved portion 37 is concave with respect to ring member 9. In other words, each first curved portion 36 is concave with respect to lid 8 and each second curved portion 37 is convex with respect to lid 8.

In particular, each first curved portion 36 is curved towards (points towards) ring member 9 and each second curved portion 37 is curved towards (points towards) lid 8.

Advantageously, each connecting element 10 is elastically deformable, in particular so that connecting elements 10 act in use and during handling and/or operation of closure assembly 3, in particular closing group 7, (e.g. movement of lid 8 from the closing position to the opening position) as spring elements.

In more detail, each first curved portion 36 comprises a first engagement surface 44 and each second curved portion 37 comprises a second engagement surface 45. Preferentially, each connecting element 10 is deformable such to allow for the respective first engagement surface 44 abutting against (a respective first abutment portion of first rim 27, in particular of first surface 28 of) lid 8 and second engagement surface 45 to abut against (a second abutment surface portion of second rim 29, in particular of second surface 30 of) ring member 9.

In other words, each first engagement surface 44 and each second engagement surface 45 is adapted to engage respectively the respective first abutment portion and the respective second abutment portion, in particular during handling and/or operation of closure assembly 3, even more particular during handling and/or operation of closing group 7. In particular, in use, each engagement surface 44 and each engagement surface 45 engages respectively the respective first abutment portion and the respective second abutment portion during removal of closing group 7 from a mold tool and/or during mounting of closing group 7 onto collar 14.

In addition, in use, connecting elements 10 may deform as a result of strain and/or stresses and/or forces acting during handling and/or operation of closure assembly 3, in particular closing group 7, (e.g. movement of lid 8 from the closing position to the opening position).

In use, a consumer operates closure assembly 3, in particular closing group 7, so as to selectively open and close pouring outlet 15 by controlling lid 8 in the opening configuration or the closing position.

In particular, prior to the first-time operation of closure assembly 3, in particular of closing group 7, lid 8 is in the closing position and first coupling bridges 11 and preferentially also second coupling bridges 13 are intact (i.e. not ruptured). The first time lid 8 is controlled from the closing position to the opening position, first coupling bridges 11 and preferentially also second coupling bridges 13 irreversibly rupture.

Thereby, connecting elements 10 guarantee that lid 8 and ring member 9 remain connected (tethered) to one another. Additionally, this means that lid 8 remains coupled to collar 14 by means of ring member 9. Furthermore, tamper evidence ring 12 is detached from ring member 9 and allows for a tamper evidence.

Furthermore, during the first-time control of lid 8 from the rest position to the operative position, cutting device 18 is activated, in particular cutting and/or piercing and/or opening and/or rupturing the separation membrane.

During operation of closing group 7, in particular control of lid 8, between the closing position and the opening position, connecting elements 10 elastically deform thereby at least partially absorbing the external stresses and/or forces acting on closure assembly 3 and/or closing group 7.

Moreover, each first engagement surface 44 and each second engagement surface 45 may abut against respectively the relative first abutment portion and the relative second abutment portion.

The advantages of closure assembly 3 according to the present invention will be clear from the foregoing description.

In particular, connecting elements 10 allow to damp any strain and/or stresses and/or forces acting on closure assembly 3, in particular closing group 7.

A further advantage has been observed in that the handling and/or operation of closure assembly 3, in particular closing group 7, is more consumer-friendly.

Furthermore, by providing for more than one connection element 10 it is possible to increase the tethering force between ring member 9 and lid 8.

Another advantage is related to the mounting of closing group 7 onto collar 14. In order to mount closing group 7 onto collar 14, closing group 7 is forced onto collar 14. Thereby, connection elements 10 absorb at least some of the acting forces reducing thereby the risk of a possible deformation of collar 14 and/or container 1 and/or closing group 7. In particular, each first engagement surface 44 and each second engagement surface 45 abut against lid 8 and ring member 9, respectively.

The applicant has also observed that the specific formation of connection elements 10 allows to design longer-lasting molding tools with respect to connection elements 10 having other shapes. In particular, the specific conformation and size of connection elements 10 allow to provide for molding tools having portions defining connection elements 10 and which portions come along with dimensions which provide for a longer lifetime.

Furthermore, during unmolding of closing group 7 from the molding tool, first engagement surface 44 and second engagement surface 45 abut against lid 8 and ring member 9, respectively, limiting thereby the deformation.

Clearly, changes may be made to container 1 and/or closure assembly 3 as described herein without, however, departing from the scope of protection as defined in the accompanying claims.

The invention claimed is:

1. A closure assembly for a container filled or fillable with a pourable product comprising at least:

a lid having a first rim;

a ring member having a second rim facing the first rim;

a tamper-evidence ring and at least one rupturable coupling bridge designed to rupturably connect and/or rupturably connecting the ring member and the tamper-evidence ring to one another; and one or more coupling elements connected to the lid and to the ring member;

wherein each coupling element comprises at least:

one respective intermediate portion;

one respective first curved portion connected to the first rim and the intermediate portion; and one respective second curved portion connected to the second rim and the intermediate portion;

wherein the intermediate portion is inclined with respect to the first rim of the lid and/or the second rim of the ring member.

2. The closure assembly according to claim 1, wherein the first rim has a first surface;

wherein the second rim has a second surface facing the first surface;

wherein each first curved portion is connected to the first surface and each second curved portion is connected to the second surface;

wherein each intermediate portion is inclined with respect to the first surface and/or the second surface.

3. The closure assembly according to claim 2, wherein the first surface extends within a first plane and/or the second surface extends within a second plane;

wherein each intermediate portion is inclined with respect to the first plane and/or the second plane.

4. The closure assembly according to claim 3, wherein the first plane and the second plane are parallel to one another.

5. The closure assembly according to claim 1, wherein the first curved portion is connected to the first rim at a first position and the second curved portion is connected to the second rim at a second position;

wherein the first position and the second position are angularly displaced from one another.

6. The closure assembly according to claim 1, and further comprising an interspace arranged between and/or delimited by the lid and the ring member;

wherein each coupling element is positioned within the interspace.

7. The closure assembly according to claim 1, wherein each first curved portion is connected to a first end of the intermediate portion and each second curved portion is connected to a second end of the intermediate portion.

8. The closure assembly according to claim 1, wherein each coupling element is S-shaped.

9. The closure assembly according to claim 1, wherein each first curved portion is convex with respect to the ring member and each second curved portion is concave with respect to the ring member.

10. The closure assembly according to claim 1, wherein each first curved portion is curved towards the ring member and each second curved portion is curved towards the lid.

11. The closure assembly according to claim 1, wherein each coupling element is elastically deformable.

12. The closure assembly according to claim 1, wherein each first curved portion comprises a first engagement surface and each second curved portion comprises a second engagement surface;

wherein each coupling element is deformable such to allow for the first engagement surface to abut against the lid and for the second engagement surface to abut against the ring member.

13. The closure assembly according to claim 1, and further comprising a collar having a pouring outlet;

wherein the ring member is mounted to and arranged around the collar;

wherein the lid is configured to selectively close and open the pouring outlet.

14. A container for a pourable product comprising at least one main body being filled or being fillable with the pourable product and at least one closure assembly according to claim 1.

15. A closure assembly couplable to a container filled or fillable with a pourable product, the closure assembly comprising at least:

a lid that is rotatable and has a first rim;

a ring member having a second rim facing the first rim;

a coupling element connected to the lid and to the ring member;

a tamper-evidence ring positioned so that the ring member is axially between the lid and the tamper-evidence ring;

at least one rupturable coupling bridge connecting the tamper-evidence ring and the ring member;

a tubular cutting device movable from a rest position to an operative position in response to initial rotation of the lid when the closure assembly is coupled to the container to produce a hole in the container;

the coupling element comprising at least:

one respective intermediate portion;

one respective first curved portion connected to the first rim and the intermediate portion;

one respective second curved portion connected to the second rim and the intermediate portion; and the intermediate portion being inclined with respect to the first rim of the lid and/or the second rim of the ring member.

16. The closure assembly according to claim 15, wherein each first curved portion comprises a first engagement surface and each second curved portion comprises a second engagement surface, each coupling element being deformable such that the first engagement surface abuts against the lid and the second engagement surface abuts against the ring member.

17. A closure assembly couplable to a container filled or fillable with a pourable product, the closure assembly comprising at least:

a tubular collar surrounding a flow channel for the pourable product;

a lid engaged with and rotatable relative to the collar, the lid having a top wall and a first rim;

a ring member having a second rim facing the first rim;

a coupling element connecting the lid and to the ring member;

a tubular cutting device positioned inside the tubular collar and movable away from the top wall of the lid from a rest position to an operative position in response to initial rotation of the lid when the closure assembly is coupled to the container to produce a hole in the container;

the coupling element comprising at least:

one respective intermediate portion;

one respective first curved portion connected to the first rim and the intermediate portion;

one respective second curved portion connected to the second rim and the intermediate portion; and the intermediate portion being inclined with respect to the first rim of the lid and/or the second rim of the ring member; and each first curved portion comprising a first engagement surface and each second curved portion comprising a second engagement surface, each coupling element being deformable such that the first engagement surface abuts against the lid and the second engagement surface abuts against the ring member.

18. The closure assembly according to claim 17, further comprising: i) a tamper-evidence ring positioned so that the ring member is axially between the lid and the tamper-evidence ring; and ii) at least one rupturable coupling bridge connecting the tamper-evidence ring and the ring member.

* * * * *